US008592127B2

(12) United States Patent
Eida

(10) Patent No.: US 8,592,127 B2
(45) Date of Patent: Nov. 26, 2013

(54) METHOD FOR PRODUCING TONER

(75) Inventor: Akihiro Eida, Wakayama (JP)

(73) Assignee: Kao Corporation, Tokyo (JP)

( * ) Notice: Subject to any disclaimer, the term of this patent is extended or adjusted under 35 U.S.C. 154(b) by 897 days.

(21) Appl. No.: 12/510,576

(22) Filed: Jul. 28, 2009

(65) Prior Publication Data

US 2010/0035175 A1 Feb. 11, 2010

(30) Foreign Application Priority Data

Aug. 8, 2008 (JP) ..... 2008-206202

(51) Int. Cl.
*G03G 9/00* (2006.01)

(52) U.S. Cl.
USPC ..... 430/137.1; 430/137.18; 430/109.1

(58) Field of Classification Search
USPC ..... 430/137.1, 137.18, 109.1
See application file for complete search history.

(56) References Cited

U.S. PATENT DOCUMENTS 6,890,695 B2 5/2005 Shirai et al.
2005/0214670 A1* 9/2005 Matsumoto et al. ..... 430/109.4
2007/0020548 A1* 1/2007 Tanaka et al. ..... 430/109.1
2007/0269732 A1* 11/2007 Matsumura et al. ..... 430/114
2008/0248414 A1* 10/2008 Mizuhata et al. ..... 430/109.4
2008/0268365 A1* 10/2008 Yamazaki et al. ..... 430/109.4
2011/0223531 A1* 9/2011 Mizuhata et al. ..... 430/109.4

FOREIGN PATENT DOCUMENTS

JP 2002-287426 10/2002
JP 2004-279476 10/2004
WO WO 2009020155 * 2/2009

* cited by examiner

*Primary Examiner* — Mark F Huff
*Assistant Examiner* — Rachel Zhang
(74) *Attorney, Agent, or Firm* — Oblon, Spivak, McClelland, Maier & Neustadt, L.L.P.

(57) ABSTRACT

A method for producing a toner, comprising the step of feeding raw materials containing a resin binder and a colorant to an open-roller type kneader, and melt-kneading the raw materials, wherein the resin binder contains a crystalline polyester and an amorphous polyester, and wherein the crystalline polyester and the amorphous polyester fed to the open-roller type kneader are in a weight ratio, i.e. crystalline polyester/amorphous polyester, of from 5/95 to 30/70, and have a ratio of average particle sizes of crystalline polyester/amorphous polyester of from 1.5 to 4.0. The toner obtained according to the present invention is used in, for example, the development of a latent image formed in electrophotography, electrostatic recording method, electrostatic printing method or the like.

20 Claims, No Drawings

METHOD FOR PRODUCING TONER

FIELD OF THE INVENTION

The present invention relates to a method for producing a toner, which is used in, for example, the development of a latent image formed in electrophotography, electrostatic recording method, electrostatic printing method or the like.

BACKGROUND OF THE INVENTION

Improvement in low-temperature fixing ability of the toner is desired, from the viewpoint of conservation of energy, shortening of idling time, miniaturization of the apparatus, or the like. In view of the above, one technique for improving low-temperature fixing ability is a technique in which a crystalline resin and an amorphous resin that rapidly melt at a fixing temperature are used as binder resins, and the crystalline polyester is contained in an amount of 1 to 40% by weight of the resin binder, and 90% or more of the dispersed domain of the crystalline polyester in the toner is adjusted to a diameter of from 0.1 to 2 μm (see JP-A-2002-287426). Moreover, as a method of adjusting a diameter of the dispersed domain of a crystalline polyester in the toner, a method of adjusting softening temperatures of a crystalline polyester and an amorphous resin, kneading conditions upon the toner production, or the like is proposed.

In addition, for the purpose of obtaining a toner having excellent low-temperature fixing ability, offset resistance, and durability, favorable resolution, and providing high-quality image free from background fogging or unevenness in image densities, there is a technique of adjusting the maximum particle size of the dispersed domain of the crystalline polyester in the toner so that the major axis diameter is 0.5 μm or more, and that the maximum particle size of dispersed domain is ½ or less than the maximum particle size of the toner (see JP-A-2004-279476). Moreover, in order to adjust the particle size of the dispersed domain of the crystalline polyester in the toner, the crystalline polyester fed to a kneader in the step of kneading toner raw materials is formed into fine particles.

SUMMARY OF THE INVENTION

The present invention relates to a method for producing a toner, including the step of feeding raw materials containing a resin binder and a colorant to an open-roller type kneader, and melt-kneading the raw materials, wherein the resin binder contains a crystalline polyester and an amorphous polyester, and wherein the crystalline polyester and the amorphous polyester fed to the open-roller type kneader are in a weight ratio, i.e. crystalline polyester/amorphous polyester, of from 5/95 to 30/70, and have a ratio of average particle sizes of crystalline polyester/amorphous polyester of from 1.5 to 4.0.

DETAILED DESCRIPTION OF THE INVENTION

With respect to a method of adjusting the diameter of the dispersed domain of a crystalline polyester in a toner, in a method of JP-A-2002-287426, a softening temperature of a resin or kneading conditions may be restricted. In addition, in a method of JP-A-2004-279476, a crystalline polyester fed to a kneader needs to be formed into fine particles to the level that particle sizes are in the order of several microns.

The present invention relates to a method for producing a toner capable of obtaining a toner having an excellent low-temperature fixing ability and an excellent durability under high-temperature environmental conditions in a high yield in pulverization and classification, with less restrictions on the physical properties of the resin and the kneading conditions during the production of a toner.

According to the present invention, a toner having an excellent low-temperature fixing ability and an excellent durability under high-temperature environmental conditions can be obtained in a high yield in pulverization and classification, by a method with less restrictions on the physical properties of the resin and the kneading conditions during the production of a toner.

These and other advantages of the present invention will be apparent from the following description.

As a result of intensive studies in order to solve the above-mentioned problems, the present inventors have found that a toner having an excellent low-temperature fixing ability and an excellent durability under high-temperature environmental conditions is obtained in a high yield in pulverization and classification by adjusting particle sizes of a crystalline polyester and an amorphous polyester that are fed to an open-roller type kneader. Thus, the present invention has been completed thereby.

One of the great features of the present invention resides in that a method for producing a toner includes the step of feeding raw materials containing a resin binder and a colorant to an open-roller type kneader, and melt-kneading the mixture, wherein the resin binder contains a crystalline polyester and an amorphous polyester, and wherein the crystalline polyester and the amorphous polyester fed to the kneader are in a specified weight ratio, and have a ratio of average particle sizes of the two polyesters adjusted within a specified range.

Since a crystalline polyester has excellent compatibility with an amorphous polyester, the crystallinity of the crystalline polyester is lowered during the kneading by the compatibility with the amorphous polyester. If these two polyesters are completely compatible to each other, the entire resin binder would be plasticized, so that low-temperature fixing ability is improved. On the other hand, durability under high-temperature environmental conditions is lowered due to a lowered strength of the entire resin binder. However, although not wanting to be limited by theory, in the present invention, it is presumed that the formation of a compatible mixture of the two polyesters can be suppressed, with less restrictions on the physical properties of the resin and the kneading conditions during the production of toner, by previously adjusting a particle size of a crystalline polyester to be larger than that of an amorphous polyester, and that the two polyesters are appropriately dispersed with each other, whereby a toner satisfying both improved low-temperature fixing ability and durability under high-temperature environmental conditions (hereinafter, the term "durability" as used to herein refers to durability under high-temperature environmental conditions) is accomplished.

The ratio of average particle sizes of the crystalline polyester to the amorphous polyester (crystalline polyester/amorphous polyester) fed to the open-roller type kneader is 1.5 or more, and preferably 2.0 or more, from the viewpoint of preventing excessive formation of a compatible mixture between the two polyesters and improving durability of the toner. Also, the ratio of average particle sizes of the crystalline polyester to the amorphous polyester is 4.0 or less, preferably 3.5 or less, more preferably 3.0 or less, and even more preferably 2.5 or less, from the viewpoint of preventing deterioration of dispersibility of the crystalline polyester in the toner and improving low-temperature fixing ability of the toner. Therefore, from the overall viewpoint, the above-mentioned ratio of average particle sizes is from 1.5 to 4.0, preferably from 1.5 to 3.5, more preferably from 1.5 to 3.0, even more preferably from 2.0 to 3.0, and even more preferably from 2.0 to 2.5.

The average particle sizes of the crystalline polyester and the amorphous polyester fed to the open-roller type kneader can be adjusted by the size of a sieve opening of a screen at a discharging outlet of a pulverizer used before feeding to the kneader. As the pulverizer, Rotoplex, Atomizer, or the like can be used. When the average particle size of a polyester is to be made larger, a screen having a large sieve opening is used, and when the average particle size is to be made smaller, a screen having a small sieve opening is used. Here, in order that resin particles are pulverized to a particle size of 1.0 mm or less, it is necessary to use a screen having a sieve opening of 1.0 mm or less. In order to pulverize a resin to a size of 1.0 mm or less, the amount fed to the pulverizer must be reduced, thereby worsening the productivity, and aggregation increases when the particle size of the resin is too small, so that accumulation of the particles in the pulverizer is generated, thereby drastically lowering the operability. Therefore, it is preferable to select a screen having an appropriate sieve opening. The sieve opening is preferably from 2 to 15 mm, and more preferably from 3 to 10 mm.

The crystalline polyester has an average particle size of preferably 1.5 mm or more, and more preferably 2.0 mm or more, from the viewpoint of improving the productivity of a pulverized product of resin, as mentioned above. Also, the crystalline polyester has an average particle size of preferably 5.5 mm or less, more preferably 4.0 mm or less, even more preferably 3.5 mm or less, and even more preferably 3.0 mm or less, from the viewpoint of improving the adhesion of the resin to the kneading portion of the open-roller type kneader and from the viewpoint of improving low-temperature fixing ability of the toner. Therefore, from the overall viewpoint, the crystalline polyester has an average particle size of preferably from 1.5 to 5.5 mm, more preferably 1.5 to 4.0 mm, even more preferably 2.0 to 3.5 mm, and even more preferably 2.0 to 3.0 mm.

In the present invention, the average particle size of the crystalline polyester is obtained as follows. A resin sample is sequentially sieved through 8 sieves having openings of 10 mm, 7 mm, 5 mm, 3 mm, 2 mm, 1 mm, 0.5 mm and 0.2 mm, the weight of the resin sample remaining on each sieve is measured to obtain the mass base frequency, and the average particle size is calculated according to the following formula using the values of sieve openings and mass base frequencies for the weight of the resin sample on each sieve. Here, in the following formula, the resin sample passing through the sieve having a sieve opening of 0.2 mm is counted as a resin having a size of 0.1 mm.

Average Particle Size (mm)=10×(mass base frequency of the weight of resin on a 10 mm sieve)+7×(mass base frequency of the weight of resin on a 7 mm sieve)+5×(mass base frequency of the weight of resin on a 5 mm sieve)+3×(mass base frequency of the weight of resin on a 3 mm sieve)+2×(mass base frequency of the weight of resin on a 2 mm sieve)+1×(mass base frequency of the weight of resin on a 1 mm sieve)+0.5×(mass base frequency of the weight of resin on a 0.5 mm sieve)+0.2×(mass base frequency of the weight of resin on a 0.2 mm sieve)+0.1×(mass base frequency of the weight of resin passing through a 0.2 mm sieve)

The amorphous polyester has an average particle size of preferably 0.5 mm or more, and more preferably 1.0 mm or more, from the viewpoint of improving the productivity of a pulverized product of resin. Also, the amorphous polyester has an average particle size of preferably 4.0 mm or less, and more preferably 3.0 mm or less, from the viewpoint of improving adhesion of the resin to the kneading portion of the open-roller type kneader. Therefore, from the overall viewpoint, the amorphous polyester has an average particle size of preferably from 0.5 to 4.0 mm, and more preferably 1.0 to 3.0 mm.

The weight ratio of the crystalline polyester to the amorphous polyester (crystalline polyester/amorphous polyester) fed to the open-roller type kneader is 5/95 or more, preferably 10/90 or more, and more preferably 15/85 or more, from the viewpoint of improving low-temperature fixing ability of the toner. Also, the weight ratio is 30/70 or less, and preferably 25/75 or less, from the viewpoint of improving yield in pulverization and classification of toner. Therefore, from the overall viewpoint, the weight ratio is from 5/95 to 30/70, preferably from 10/90 to 25/75, and more preferably from 15/85 to 25/75.

The crystallinity of the polyester is expressed as a crystallization index defined as a ratio of a softening temperature to a highest temperature of endothermic peak determined with a differential scanning calorimeter, i.e., a value calculated from [softening temperature/highest temperature of endothermic peak]. In the present invention, the crystalline polyester has a value calculated from [softening temperature/highest temperature of endothermic peak] of from 0.6 to 1.4, preferably from 0.7 to 1.2, and more preferably from 0.9 to 1.2, and the amorphous polyester has a value calculated from [softening temperature/highest temperature of endothermic peak] of more than 1.4 or less than 0.6, and preferably more than 1.5. The crystallinity of the polyester can be adjusted by the kinds of the raw material monomers and a ratio thereof, production conditions (for example, reaction temperature, reaction time, and cooling rate), and the like. Here, the highest temperature of endothermic peak refers to a temperature of the peak on the highest temperature side among endothermic peaks observed. When a difference between the highest temperature of endothermic peak and the softening temperature is within 20° C., the highest temperature of endothermic peak is defined as a melting point. When the difference between the highest temperature of endothermic peak and the softening temperature exceeds 20° C., the endothermic peak is ascribed to a glass transition.

It is preferable that the crystalline polyester is a polyester obtained by polycondensing an alcohol component containing an α,ω-linear alkanediol and a carboxylic acid component containing an aliphatic dicarboxylic acid compound and/or an aromatic dicarboxylic acid compound, from the viewpoint of enhancement of the crystallinity.

The α,ω-linear alkanediol is preferably a diol having 2 to 8 carbon atoms, and more preferably a diol having 4 to 6 carbon atoms. The α,ω-linear alkanediol includes ethylene glycol, 1,2-propanediol, 1,3-propanediol, 1,4-butanediol, 1,5-pentanediol, 1,6-hexanediol, neopentyl glycol and the like. Among them, 1,4-butanediol and 1,6-hexanediol are more preferable, from the viewpoint of enhancement of the crystallinity.

The α,ω-linear alkanediol is contained in an amount of preferably 60% by mol or more, more preferably 80 to 100% by mol, even more preferably 90 to 100% by mol, and even more preferably 95 to 100% by mol, of the alcohol component, from the viewpoint of enhancement of the crystallinity of crystalline polyester.

The alcohol component may contain a polyhydric alcohol component other than the aliphatic diol having 2 to 6 carbon atoms, and the polyhydric alcohol component includes aromatic diols such as an alkylene oxide adduct of bisphenol A, represented by the formula (I):

(I)

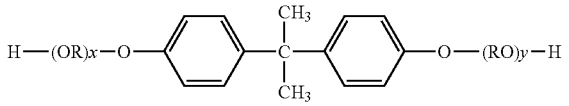

wherein RO and OR are an oxyalkylene group, wherein R is an ethylene and/or propylene group, x and y each shows the number of moles of the alkylene oxide added, each being a positive number, and the sum of x and y on average is preferably from 1 to 16, more preferably from 1 to 8, and even more preferably from 1.5 to 4; trihydric or higher polyhydric alcohols such as glycerol, pentaerythritol, trimethylolpropane, sorbitol, and 1,4-sorbitan; and the like.

It is preferable that the dicarboxylic acid compound is an aliphatic dicarboxylic acid compound having 2 to 8 carbon atoms, preferably 4 to 6 carbon atoms, and more preferably 4 carbon atoms, and an aromatic dicarboxylic acid compound having 8 carbon atoms, from the viewpoint of enhancement of the crystallinity of crystalline polyester. Here, the dicarboxylic acid compound refers to dicarboxylic acids, acid anhydrides thereof, and alkyl (1 to 8 carbon atoms) esters thereof. Among them, the dicarboxylic acids are preferable. Also, the preferred number of carbon atoms means the number of carbon atoms in the dicarboxylic acid moiety of the dicarboxylic acid compound.

The aliphatic dicarboxylic acid having 2 to 8 carbon atoms includes oxalic acid, malonic acid, maleic acid, fumaric acid, citraconic acid, itaconic acid, glutaconic acid, succinic acid, adipic acid, and the like, among which fumaric acid is preferable from the viewpoint of enhancement of the crystallinity of the crystalline polyester.

The aromatic dicarboxylic acid having 8 carbon atoms includes phthalic acid, isophthalic acid, terephthalic acid, and the like. Among them, terephthalic acid is preferable from the viewpoint of enhancement of the crystallinity of the crystalline polyester.

The aliphatic dicarboxylic acid compound having 2 to 8 carbon atoms or the aromatic dicarboxylic acid compound having 8 carbon atoms is contained in an amount, or in a total amount in a case where the two compounds are used together, of preferably 60% by mol or more, more preferably from 80 to 100% by mol, even more preferably from 90 to 100% by mol, even more preferably from 95 to 100% by mol, of the carboxylic acid component, from the viewpoint of enhancement of the crystallinity of the crystalline polyester.

The carboxylic acid component may contain a polycarboxylic acid compound other than the aliphatic dicarboxylic acid compound having 2 to 8 carbon atoms and the aromatic dicarboxylic acid compound having 8 carbon atoms, and the polycarboxylic acid compound includes aliphatic dicarboxylic acids such as sebacic acid, azelaic acid, n-dodecylsuccinic acid, and n-dodecenylsuccinic acid; alicyclic dicarboxylic acids such as cyclohexanedicarboxylic acid; tricarboxylic or higher polycarboxylic acids such as trimellitic acid and pyromellitic acid; acid anhydrides thereof, alkyl (1 to 8 carbon atoms) esters thereof; and the like.

Further, the alcohol component may properly contain a monohydric alcohol, and the carboxylic acid component may properly contain a monocarboxylic acid compound, within the range that would not impair the effects of the present invention, from the viewpoint of adjusting the molecular weight of the resin and the like.

Here, the molar ratio of the dicarboxylic acid compound to the α,ω-linear alkanediol in the crystalline polyester, i.e. dicarboxylic acid compound/α,ω-linear alkanediol, is preferably 0.9 or more and less than 1.0, and more preferably 0.95 or more and less than 1.0, from the viewpoint of production stability, and further from the viewpoint of being capable of easily adjusting the molecular weight of the resin by evaporation during a vacuum reaction in a case where the α,ω-linear alkanediol is contained in a large amount.

The crystalline polyester is obtained by a method including polycondensing the alcohol component and the carboxylic acid component in an inert gas atmosphere at a temperature of from 120° to 230° C., using an esterification catalyst, a polymerization inhibitor, or the like as occasion demands. Specifically, a method including the step of charging an entire monomer in a single batch in order to increase the strength of the resin, or alternatively, in order to reduce low-molecular weight components, a method including the steps of firstly reacting divalent monomers and thereafter adding a trivalent or higher polyvalent monomer thereto to react, or the like may be employed. In addition, the reaction may be accelerated by reducing pressure of a reaction system in a latter half of the polymerization. Here, in order to obtain a polyester having high crystallinity, it is preferable that the polyester is formed to have a larger molecular weight, and it is more preferable that the reaction is carried out until the viscosity of the reaction mixture becomes high. In order to obtain a polyester having high crystallinity formed to have a larger molecular weight, reaction conditions such as adjustment of the molar ratio of the dicarboxylic acid compound to the α,ω-linear alkanediol as mentioned above, elevation of the reaction temperature, increase in the amount of the catalyst, and subjection to a dehydration reaction for a long period of time under reduced pressure may be selected. Here, a polyester having high crystallinity formed to have a larger molecular weight can be also produced by stirring raw material monomers with a high output motor. When the polyester is produced without particularly selecting production equipment, a method including the step of reacting raw material monomers together with a non-reactive low-viscosity resin and a solvent is also an effective means.

The crystalline polyester has a number-average molecular weight of preferably 3,000 or more, and more preferably 4,000 or more, from the viewpoint of improving durability of the toner. Also, the crystalline polyester has a number-average molecular weight of preferably 10,000 or less, and more preferably 9,000 or less, from the viewpoint of improving efficiency in pulverization and classification of the toner. Therefore, from the overall viewpoint, the crystalline polyester has a number-average molecular weight of preferably from 3,000 to 10,000, and more preferably from 4,000 to 9,000.

The crystalline polyester has a weight-average molecular weight of preferably 30,000 or more, and more preferably 40,000 or more, from the same viewpoint. Also, the crystalline polyester has a weight-average molecular weight of preferably 100,000 or less, and more preferably 70,000 or less, from the same viewpoint. Therefore, from the overall viewpoint, the crystalline polyester has a weight-average molecular weight of preferably from 30,000 to 100,000, and more preferably from 40,000 to 70,000. The number-average molecular weight and the weight-average molecular weight of the crystalline polyester can be measured in accordance with the methods described in Examples set forth below.

The crystalline polyester has a highest temperature of endothermic peak of preferably 100° C. or higher, from the viewpoint of improving storage property and durability of the toner. Also, the crystalline polyester has a highest temperature of endothermic peak of preferably 140° C. or lower, more preferably 130° C. or lower, and even more preferably 120° C. or lower, from the viewpoint of improving low-temperature fixing ability of the toner. From the overall viewpoint, the crystalline polyester has a highest temperature of endothermic peak of from preferably from 100° to 140° C., more preferably from 100° to 130° C., and even more preferably from 100° to 120° C.

The crystalline polyester has a softening temperature of preferably 80° C. or higher, and more preferably 90° C. or higher, from the viewpoint of improving the durability. Also, the crystalline polyester has a softening temperature of preferably 130° C. or lower, and more preferably 120° C. or lower, from the viewpoint of lowering the lowest fixing temperature. That is, from the overall viewpoint, the crystalline polyester has a softening temperature of preferably from 80° to 130° C., and more preferably 90° to 120° C.

The amorphous polyester can be produced by polycondensation of an alcohol component and a carboxylic acid component in an inert gas atmosphere at a temperature of from 180° to 250° C. or so, in the presence of an esterification catalyst, a polymerization inhibitor, or the like as occasion demands, in the same manner as in the crystalline polyester. Here, in order to produce an amorphous polyester, it is preferable that the following requirements are met:

(1) in a case where monomers for accelerating crystallization of a resin, such as an aliphatic diol having 2 to 6 carbon atoms and an aliphatic dicarboxylic acid compound having 2 to 8 carbon atoms, are used, a resin in which crystallization is suppressed by using two or more of these monomers in combination, in each of the alcohol component and the carboxylic acid component, one of these monomers is used in an amount of from 10 to 70% by mol, and preferably from 20 to 60% by mol of each component, and these monomers are used in two or more kinds, preferably two to four kinds; or (2) a resin obtained from monomers for accelerating amorphousness of a resin, preferably an alkylene oxide adduct of bisphenol A as an alcohol component, or a substituted succinic acid of which substituent is an alkyl group or alkenyl group as a carboxylic acid component are used in an amount of from 30 to 100% by mol, and preferably from 50 to 100% by mol, of at least one component in the alcohol component or the carboxylic acid component, in either one of the alcohol component or the carboxylic acid component, and preferably in both of the alcohol component and the carboxylic acid component, respectively.

In the present invention, the amorphous polyester containing a polyester component obtained by polycondensation of an alcohol component and a carboxylic acid component includes not only polyesters but also modified resins thereof.

Here, in the present invention, the polyester may be a modified polyester to an extent that the properties thereof are not substantially impaired. The modified polyester includes, for example, a polyester grafted or blocked with a phenol, a urethane, an epoxy or the like according to the method described in JP-A-Hei-11-133668, JP-A-Hei-10-239903, JP-A-Hei-8-20636, or the like, and a composite resin containing two or more kinds of resin units including a polyester unit.

It is preferable that the amorphous polyester has a softening temperature higher than that of the crystalline polyester, from the viewpoint of improving high-temperature offset resistance of the toner, and that the difference in their softening temperatures is preferably within 30° C., more preferably from 2° to 30° C., and even more preferably 2° to 20° C.

The softening temperature of the amorphous polyester can be easily adjusted by, for example, selection of raw material monomers including a carboxylic acid component or the like or reaction time. The amorphous polyester has a softening temperature of 140° C. or higher, preferably from 140° to 180° C., and more preferably from 140° to 160° C., from the viewpoint of durability and high-temperature offset resistance of the toner. On the other hand, the amorphous polyester has a softening temperature of lower than 140° C., preferably 100° C. or higher and lower than 140° C., and more preferably 110° C. or higher and lower than 140° C., from the viewpoint of improvement in the fixing strength and the gloss of the toner.

The amorphous polyester has a glass transition temperature of preferably 40° C. or higher, and more preferably 50° C. or higher, from the viewpoint of improving storage stability and the durability of the toner. Also, the amorphous polyester has a glass transition temperature of preferably 80° C. or lower, and more preferably 70° C. or lower, from the viewpoint of improving low-temperature fixing ability of the toner and from the viewpoint of improving pulverizability of a melt-kneaded mixture of the raw materials for the toner. That is, from the overall viewpoint, the amorphous polyester has a glass transition temperature of preferably from 40° to 80° C., and more preferably from 50° to 70° C. Incidentally, glass transition temperature is a physical property intrinsically owned by an amorphous resin, and is distinguished from the highest temperature of endothermic peak.

The amorphous polyester has a highest temperature of endothermic peak of preferably 50° C. or higher, more preferably 55° C. or higher, and even more preferably 60° C. or higher, from the viewpoint of improving storage property and durability of the toner. Also, the amorphous polyester has a highest temperature of endothermic peak of preferably 90° C. or lower, more preferably 85° C. or lower, and even more preferably 80° C. or lower, from the viewpoint of improving low-temperature fixing ability of the toner. From the overall viewpoint, the amorphous polyester has a highest temperature of endothermic peak of preferably from 50° to 90° C., more preferably from 55° to 85° C., and even more preferably from 60° to 80° C.

In addition, the amorphous polyester has an acid value of preferably 30 mgKOH/g or less, more preferably 20 mgKOH/g or less, and even more preferably 10 mgKOH/g or less, from the viewpoint of triboelectric stability of the toner under high-temperature, high-humidity environmental conditions.

The resin binder may properly contain a resin other than the polyester such as a vinyl resin, an epoxy resin, a polycarbonate, or a polyurethane within the range so as not to impair the effects of the present invention. The crystalline polyester and the amorphous polyester are contained in a total amount of preferably 80% by weight or more, more preferably 90% by weight or more, and even more preferably substantially 100% by weight, of the resin binder.

As the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. The colorant is contained in an amount of preferably from 1 to 40 parts by weight, and more preferably from 2 to 10 parts by weight, based on 100 parts by weight of the resin binder.

In the toner of the present invention, an additive such as a releasing agent, a charge control agent, a fluidity improver, an electric conductivity modifier, an extender pigment, a reinforcing filler such as a fibrous material, an antioxidant, an anti-aging agent, or a cleanability improver may be further appropriately added internally or externally.

The releasing agent includes aliphatic hydrocarbon waxes such as low-molecular weight polypropylenes, low-molecular weight polyethylenes, low-molecular weight polypropylene-polyethylene copolymers, microcrystalline waxes, paraffinic waxes, and Fischer-Tropsch wax, and oxides thereof; ester waxes such as carnauba wax, montan wax, and sazole wax, and deacidified waxes thereof, and fatty acid ester waxes; fatty acid amides, fatty acids, higher alcohols, metal salts of fatty acids, and the like. Among them, the paraffinic waxes and carnauba wax are preferable, from the viewpoint of improving durability of the toner and from the viewpoint of improving low-temperature fixing ability.

The releasing agent is contained in a an amount of preferably from 1 to 20 parts by weight, and more preferably from 3 to 15 parts by weight, based on 100 parts by weight of the resin binder, from the viewpoint of improving durability of the toner and from the viewpoint of improving low-temperature fixing ability.

The crystalline polyester and the amorphous polyester in the present invention are pulverized so as to have a given average particle size before feeding them to a melt-kneader, as mentioned above.

The melt-kneading of the raw materials can be carried out, for example, by appropriately mixing a resin binder, a colorant, a releasing agent, a charge control agent and the like with a mixer such as a Henschel mixer, or a Super mixer, and then supplying the mixture into an open-roller type kneader using a subtraction type screw feeder or the like. Here, it is preferable that the raw materials are supplied to an upper side of the rollers of the kneader or into a gap between the rollers, wherein the rollers are rotated in counter directions to each other in a manner that the rollers are rotated in a downward direction.

In the method for producing a toner of the present invention, the melt-kneading step is carried out using an open-roller type kneader, from the viewpoint of improving yield in pulverization and classification of the toner. The open-roller type kneader refers to a kneader of which melt-kneading member is not sealed but open, and can easily dissipate the kneading heat generated during the melt-kneading. The open-roller type kneader used in the present invention is one which is provided with a plurality of feeding inlets for raw materials and a discharging outlet for a kneaded mixture arranged along an axial direction of the roller, and it is preferable that the kneader is a continuous open-roller type kneader from the viewpoint of production efficiency.

It is preferable that the open-roller type kneader used in the present invention has two rollers for kneading which are different in at least temperature. The temperature of the roller can be adjusted by, for example, a temperature of a heating medium passing through the inner portion of the roller, and each roller may be divided in two or more portions in the inner portion of the roller, each being communicated with heating media of different temperatures.

In the present invention, the temperature at the discharging outlet for a kneaded mixture of the kneader is preferably set, in all of the rollers, to be a temperature lower than the softening temperature of the crystalline polyester, more preferably set to a temperature lower than the softening temperature of the crystalline polyester by 5° C. or higher, and even more preferably set to from a temperature equal to or higher than room temperature to a temperature equal to or lower than the softening temperature of the crystalline polyester by 5° C. or higher, from the viewpoint of improving durability of the toner. Further, it is preferable that the temperature at the discharging outlet for a kneaded mixture of the roller having the highest temperature of the plurality of the rollers of the kneader is set to a temperature lower than the softening temperature of the crystalline polyester by 5° to 20° C.

As for the setting temperatures on the upstream side and on the downstream side of the heat roller, it is preferable that a setting temperature on the upstream side is higher than a setting temperature on the downstream side, from the viewpoint of providing excellent adhesion of a kneaded mixture to the roller on the upstream side and thereby strongly kneading the mixture on the downstream side.

In a roller having a lower setting temperature on the upstream side of the kneading (also referred to as cooling roller), the setting temperature on the upstream side of the kneading may be the same or different from the setting temperature on the downstream side of the kneading.

It is preferable that the rollers in the open-roller type kneader have peripheral speeds different from each other. Also, it is preferable in the above-mentioned open-roller type kneader including a heat roller and a cooling roller that the heat roller is a roller having a higher peripheral speed (high-rotation roller) and the cooling roller is a roller having a lower peripheral speed (low-rotation roller), from the viewpoint of improving dispersibility of the crystalline polyester in the toner and improving low-temperature fixing ability of the toner.

The peripheral speed of the high-rotation roller is preferably from 2 to 100 m/min, and more preferably from 5 to 75 m/min. The peripheral speed of the low-rotation roller is preferably from 2 to 100 m/min, more preferably from 4 to 60 m/min, and even more preferably from 4 to 50 m/min. In addition, the ratio between the peripheral speeds of the two rollers, i.e. low-rotation roller/high-rotation roller, is preferably from 1/10 to 9/10, and more preferably from 3/10 to 8/10.

The gap (clearance) between the two rollers at an end part on the upstream side of the kneading is preferably from 0.1 to 3 mm, more preferably from 0.1 to 1 mm.

In addition, structures, size, materials and the like of each roller are not particularly limited. The surface of the roller contains ditches used for kneading, and the ditches may be of any shapes, including linear, spiral, wavy, rugged or other shapes.

The feeding rate and the average residence time of the raw material mixture vary depending on the size of the roller used, the composition of the raw materials and the like. The optimum conditions thereof may be selected according to these factors.

After the melt-kneading step with the open-roller type kneader, the resulting melt-kneaded mixture is cooled to a pulverizable state, and thereafter subjected to usual processes such as a pulverizing step and a classifying step, whereby a toner of the present invention can be obtained.

In the pulverizing step, it is desired that a melt-kneaded mixture is pulverized so as to have a volume-median particle size after the pulverizing step that is smaller than the intended volume-median particle size of the toner by, for example, 0.5 to 1.0 μm or so, because fine powder is excluded in a classifying step after the pulverization, and consequently the average particle size will be slightly larger.

The pulverizing step may be carried out in divided multi-stages. For example, a melt-kneaded mixture may be roughly pulverized to a size of from 1 to 5 mm or so, and thereafter the roughly pulverized product may be further finely pulverized. Also, in order to improve the productivity during the pulverization and classifying steps, a melt-kneaded mixture may be mixed with fine inorganic particles of a hydrophobic silica or the like, and then pulverized.

The pulverizer used in the pulverizing step is not particularly limited. For example, the pulverizer preferably used in the rough pulverization includes Atomizer, Rotoplex, and the like, and a hammer mill or the like may also be used. The pulverizer preferably used in the fine pulverization includes a fluidized bed counter jet mill, an impact type jet mill, a mechanical mill, and the like.

The classifier used in the classifying step includes air classifiers, rotor type classifiers, sieve classifiers, and the like. During the classifying step, the pulverized product which is insufficiently pulverized and excluded may be subjected to the pulverizing step again, or the pulverizing step and the classifying step may be repeated, as occasion demands.

After the melt-kneading step, the toner matrix particles obtained through the pulverizing step and the classifying step may be used directly as a toner, or externally added with an external additive to the surface of the toner matrix particles. The toner and the toner matrix particles have a volume-median particle size ($D_{50}$) of preferably from 3 to 10 μm, more preferably from 3 to 8 μm, from the viewpoint of improving the image quality. The term "volume-median particle size ($D_{50}$)" as used herein means a particle size of which cumulative volume frequency calculated on a volume percentage is 50% counted from the smaller particle sizes.

The external additive includes fine inorganic particles of silica, alumina, titania, zirconia, tin oxide, zinc oxide, and the like. Among them, silica having a small specific gravity is preferred, from the viewpoint of improving the triboelectric charges of the toner.

It is preferable that the silica is a hydrophobic silica which is subjected to a hydrophobic treatment, from the viewpoint of environmental stability. The method of hydrophobic treatment is not particularly limited, and the hydrophobic treatment agent includes hexamethyl disilazane (HMDS), dimethyl dichlorosilane (DMDS), silicone oil, methyl triethoxysilane, and the like. The amount treated by the hydrophobic treatment agent is preferably from 1 to 7 $mg/m^2$ per surface area of the fine inorganic particles.

The external additive is contained in an amount of preferably from 0.1 to 10 parts by weight, and more preferably from 0.3 to 5 parts by weight, based on 100 parts by weight of the toner matrix particles.

The step of adding an external additive is preferably a dry blending method including mixing the external additive and the toner particles with a high-speed agitator such as a Henschel mixer or a Super Mixer, or a V-type blender, or the like. The external additive may be previously mixed and added in a high-speed agitator or a V-type blender, or the external additives may be separately added.

The toner of the present invention can be used as a toner for monocomponent development, or mixed with a carrier to prepare a two-component developer.

EXAMPLES

The following examples further describe and demonstrate embodiments of the present invention. The examples are given solely for the purposes of illustration and are not to be construed as limitations of the present invention.

[Average Particle Size of Resin]

A 100 g resin sample is sequentially sieved through 8 sieves having openings of 10 mm, 7 mm, 5 mm, 3 mm, 2 mm, 1 mm, 0.5 mm and 0.2 mm, and the weight of the resin sample remaining on each sieve is measured, and a mass base frequency is calculated from the weight. Specifically, the sieves are used in a descending order of the openings, a sieve with a resin sample placed thereon is vibrated for 1 minute using a vibrator, the weight of the resin sample remaining on the sieve is then measured, and a mass base frequency is determined by dividing the weight by the weight of the entire resin sample (100 g). Moreover, a resin sample passing through the sieve is sieved with a next sieve in the same manner. A resin sample on a sieve having a sieve opening of 10 mm contains a resin sample having a size of 10 mm or more; a resin sample on a sieve having a sieve opening of 7 mm contains a resin sample having a size of 7 mm or more and less than 10 mm; a resin sample on a sieve having a sieve opening of 5 mm contains a resin sample having a size of 5 mm or more and less than 7 mm; a resin sample on a sieve having a sieve opening of 3 mm contains a resin sample having a size of 3 mm or more and less than 5 mm; a resin sample on a sieve having a sieve opening of 2 mm contains a resin sample having a size of 2 mm or more and less than 3 mm; a resin sample on a sieve having a sieve opening of 1 mm contains a resin sample having a size of 1 mm or more and less than 2 mm; a resin sample on a sieve having a sieve opening of 0.5 mm contains a resin sample having a size of 0.5 mm or more and less than 1 mm; and a resin sample on a sieve having a sieve opening of 0.2 mm contains a resin sample having a size of 0.2 mm or more and less than 0.5 mm, respectively.

The average particle size is calculated according to the following formula using the values of the openings of each sieve and the mass base frequency for the weight of the resin samples on each sieve. Here, in the following formula, a resin sample passing through a 0.2 mm sieve is counted as a resin sample having a size of 0.1 mm.

Average Particle Size (mm)=10×(mass base frequency of the weight of resin on a 10 mm sieve)+7×(mass base frequency of the weight of resin on a 7 mm sieve)+5×(mass base frequency of the weight of resin on a 5 mm sieve)+3×(mass base frequency of the weight of resin on a 3 mm sieve)+2×(mass base frequency of the weight of resin on a 2 mm sieve)+1×(mass base frequency of the weight of resin on a 1 mm sieve)+0.5×(mass base frequency of the weight of resin on a 0.5 mm sieve)+0.2×(mass base frequency of the weight of resin on a 0.2 mm sieve)+0.1×(mass base frequency of the weight of resin passing through a 0.2 mm sieve)

[Softening Temperature of Resin]

The softening temperature refers to a temperature at which a half the amount of the sample flows out when plotting a downward movement of a plunger of a flow tester against temperature, as measured by using a flow tester (CAPILLARY RHEOMETER "CFT-500D," commercially available from Shimadzu Corporation), in which a 1 g sample is extruded through a nozzle having a diameter of 1 mm and a length of 1 mm while heating the sample so as to raise the temperature at a rate of 6° C./min and applying a load of 1.96 MPa thereto with the plunger.

[Highest Temperature of Endothermic Peak and Glass Transition Temperature of Resin]

The highest temperature of endothermic peak is determined using a differential scanning calorimeter ("DSC Q20," commercially available from TA Instruments, Japan), by heating a sample to 200° C., and cooling the sample from that temperature to 0° C. at a cooling rate of 10° C./min. The glass transition temperature intrinsically owned by an amorphous resin is defined as a temperature of an intersection of the extension of the baseline of equal to or lower than the highest temperature of endothermic peak and the tangential line showing the maximum inclination between the kick-off of the peak and the top of the peak in the above measurement.

[Acid Value of Resin]

The acid value is determined by a method according to JIS K0070 except that only the determination solvent is changed from a mixed solvent of ethanol and ether as defined in JIS K0070 to a mixed solvent of acetone and toluene (volume ratio of acetone:toluene=1:1).

[Average Molecular Weight of Crystalline Polyester]

The molecular weight distribution is determined by gel permeation chromatography (GPC) in accordance with the following methods. The number-average molecular weight and the weight-average molecular weight are calculated from the molecular weight distribution obtained.

(1) Preparation of Sample Solution

A resin is dissolved in chloroform, so as to have a concentration of 0.5 g/100 mL. Next, this solution is filtered with a fluororesin filter having a pore size of 2 μm (FP-200, manufactured by Sumitomo Electric Industries, Ltd.) to exclude an insoluble component, to provide a sample solution.

(2) Determination of Molecular Weight Distribution

Using the following measurement apparatus and analytical column, chloroform is allowed to flow as an eluant at a rate of 1 mL/min, and the column is stabilized in a thermostat at 40° C. One-hundred microliters of the sample solution is injected to the column to determine the molecular weight distribution. The molecular weight of the sample is calculated on the basis of a calibration curve previously prepared. The calibration curve of the molecular weight is one prepared by using several kinds of monodisperse polystyrenes (those having molecular weights of $2.63\times10^3$, $2.06\times10^4$, and $1.02\times10^5$, commercially available from Tosoh Corporation, and $2.10\times10^3$, $7.00\times10^3$, and $5.04\times10^4$, commercially available from GL Sciences Inc.) as standard samples.

Measurement Apparatus: CO-8010 (commercially available from Tosoh Corporation)

Analytical Column: GMHXL+G3000HXL (commercially available from Tosoh Corporation)

[Volume-Median Particle Size ($D_{50}$) of Toner]

Measuring Apparatus: Coulter Multisizer II (commercially available from Beckman Coulter, Inc.)

Aperture Diameter: 100 μm

Analyzing Software: Coulter Multisizer AccuComp Ver. 1.19 (commercially available from Beckman Coulter, Inc.)

Electrolytic solution: "Isotone II" (commercially available from Beckman Coulter, Inc.)

Dispersion: "EMULGEN 109P" (commercially available from Kao Corporation, polyoxyethylene lauryl ether, HLB: 13.6) is dissolved in the above electrolytic solution so as to have a concentration of 5% by weight to provide a dispersion.

Dispersion Conditions: Ten milligrams of a measurement sample is added to 5 ml of the dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size ($D_{50}$) is obtained from the particle size distribution.

Production Example 1 of Amorphous Polyester

A 5-liter four-necked flask equipped with a nitrogen inlet tube, a dehydration tube, a stirrer, and a thermocouple was charged with 1286 g of polyoxypropylene(2.2)-2,2-bis(4-hydroxyphenyl)propane, 2218 g of polyoxyethylene(2.2)-2,2-bis(4-hydroxyphenyl)propane, 1603 g of terephthalic acid, and 10 g of dibutyltin oxide. The mixture was reacted at 230° C. under nitrogen atmosphere until a reaction rate reached 90%, and the mixture obtained was then reacted at 8.3 kPa until a softening temperature reached 114° C. After cooling the reaction mixture, the mixture was pulverized with a pulverizer Rotoplex (Model 16/8, commercially available from TOA KIKAI SEISAKUSHO) using a screen having an opening of 3 mm, to provide a resin A. The resulting resin A had a softening temperature of 114.2° C., a highest temperature of endothermic peak of 71° C., a value calculated from [softening temperature/highest temperature of endothermic peak] of 1.61, a glass transition temperature of 68.5° C., an acid value of 3.2 mgKOH/g, and an average particle size of 1.1 mm. In the measurement of the average particle size, resin samples of the resin A on the sieves having openings of 10 mm, 7 mm, 5 mm and 3 mm were respectively 0 g, a resin sample on a sieve having an opening of 2 mm was 11 g, a resin sample on a sieve having an opening of 1 mm was 80 g, a resin sample on a sieve having an opening of 0.5 mm was 7 g, a resin sample on a sieve having an opening of 0.2 mm was 1 g, and a resin sample passing through a sieve having an opening of 0.2 mm was 1 g.

Production Example 2 of Amorphous Polyester

The same procedures as in Production Example 1 of Amorphous Polyester were carried out except that the opening of the screen at the discharging outlet of the pulverizer was changed to 5 mm, to provide a resin B. The resin B had an average particle size of 2.0 mm.

Production Example 1 of Crystalline Polyester

A 5-liter four-necked flask equipped with a nitrogen inlet tube, a dehydration tube, a stirrer, and a thermocouple was charged with 1575 g of 1,4-butanediol, 870 g of 1,6-hexanediol, 2950 g of fumaric acid, 2 g of hydroquinone, and 10 g of tin octylate (tin(II) 2-ethylhexanoate). The mixture was reacted at 160° C. over a period of 5 hours under nitrogen atmosphere. Thereafter, the mixture was heated to 200° C., and reacted for 1 hour. Further, the mixture was reacted at 8.3 kPa, until a softening temperature reached 110° C. After cooling the reaction mixture, the cooled mixture was pulverized in the same manner as in Production Example 1 of Amorphous Polyester, except that an opening of the screen was changed to 7 mm, to provide a resin C. The resulting resin C had a softening temperature of 112.0° C., a highest temperature of endothermic peak of 110.1° C., a value calculated from [softening temperature/highest temperature of endothermic peak] of 1.02, a number-average molecular weight of 6,000, a weight-average molecular weight of 47,000, and an average particle size of 3.5 mm. In the measurement of the average particle size, a resin sample of the resin C on a sieve having an opening of 10 mm was 0 g, a resin sample on a sieve having an opening of 7 mm was 3 g, a resin sample on a sieve having an opening of 5 mm was 21 g, a resin sample on a sieve having an opening of 3 mm was 70 g, a resin sample on a sieve having an opening of 2 mm was 5 g, a resin sample on a sieve having an opening of 1 mm was 1 g, resin samples on sieves having openings of 0.5 mm and 0.2 mm were 0 g, respectively, and a resin sample passing through a sieve having an opening of 0.2 mm was 0 g.

Production Example 2 of Crystalline Polyester

The same procedures as in Production Example 1 of Crystalline Polyester were carried out except that the opening of the screen at the discharging outlet of the pulverizer was changed to a size of 5 mm, to provide a resin D. The resin D had an average particle size of 2.4 mm.

Production Example 3 of Crystalline Polyester

The same procedures as in Production Example 1 of Crystalline Polyester were carried out except that the opening of the screen at the discharging outlet of the pulverizer was changed to a size of 10 mm, to provide a resin E. The resin E had an average particle size of 5.0 mm.

Production Example 4 of Crystalline Polyester

A 5-liter four-necked flask equipped with a nitrogen inlet tube, a dehydration tube, a stirrer, and a thermocouple was charged with 1416 g of 1,6-hexanediol, 1693 g of terephthalic acid, 259 g of adipic acid, and 6 g of dibutyltin oxide. The mixture was reacted at 200° C. until the particles of terephthalic acid were no longer observed, and the mixture was then reacted at 8.3 kPa for 3 hours. After cooling the reaction mixture, the cooled mixture was pulverized in the same manner as in Production Example 1 of Amorphous Polyester, except that an opening of the screen was changed to 5 mm, to provide a resin F. The resulting resin F had a softening temperature of 113.5° C., a highest temperature of endothermic peak of 124.3° C., a value calculated from [softening temperature/highest temperature of endothermic peak] of 0.91, a number-average molecular weight of 5,500, a weight-average molecular weight of 32,000, and an average particle size of 2.2 mm.

TABLE 1

| | | Average Particle Size (mm) |
|---|---|---|
| Amorphous Polyester | Resin A | 1.1 |
| | Resin B | 2.0 |
| Crystalline Polyester | Resin C | 3.5 |
| | Resin D | 2.4 |
| | Resin E | 5.0 |
| | Resin F | 2.2 |

Examples 1 to 7 and Comparative Examples 1 to 4

One-hundred parts by weight of resin binders shown in Table 2, 7 parts by weight of a colorant "ECB-301" (commercially available from DAINICHISEIKA COLOR & CHEMICALS MFG. CO., LTD.), 5 parts by weight of a carnauba wax "WAX-C1" (commercially available from S. Kato & CO.), and 0.5 parts by weight of a charge control agent "LR-147" (commercially available from Japan Carlit, Ltd.) were mixed in a Henschel mixer while stirring, and the mixture was melt-kneaded with an open-roller type kneader.

As the open-roller type kneader, a continuous twin roller type kneader having an outer roller diameter of 0.12 m and an effective roller length of 0.8 m was used. The continuous twin roller type kneader was operated under the conditions that a peripheral speed of a high-rotation roller (front roller) was 18.8 m/min (rotational speed: 50 r/min), a peripheral speed of a low-rotation roller (rear roller) was 11.3 m/min (rotational speed: 30 r/min), and a gap between the rollers at an end of the feeding side of the kneaded mixture was 0.1 mm. The temperature of the heating medium and the temperature of the cooling medium in the rollers were set, so that the temperature at the raw material supplying side of the high-rotation roller was 160° C., that the temperature at the kneaded mixture discharging side of the high-rotation roller was 100° C., that the temperature at the raw material feeding side of the low-rotation roller was 30° C., and that the temperature at the kneaded mixture discharging side of the low-rotation roller was 30° C. The feeding rate for the raw material mixture was 4 kg/hr, and the average residence time was about 10 minutes.

The resulting kneaded mixture was rolled with a cooling roller to cool, and the cooled mixture was then pulverized with a jet mill and classified, to provide toner matrix particles having a volume-median particle size ($D_{50}$) of 5.7 μm. Here, the ratio of the amount of the toner obtained to that of the supplied kneaded mixture was calculated as an yield in pulverization and classification to evaluate productivity. The results are shown in Table 2.

Subsequently, 100 parts by weight of the toner matrix particles and as external additives 1.0 part by weight of a hydrophobic silica "RX-50" (commercially available from Nihon Aerosil Co., Ltd., hydrophobic treatment agent: HMDS) and 0.5 parts by weight of a hydrophobic silica "R972" (commercially available from Nihon Aerosil Co., Ltd., hydrophobic treatment agent: DMDS) were stirred with a 10-liter Henschel mixer (commercially available from MITSUI MINING COMPANY, LIMITED) at 3,000 r/min for 3 minutes, to provide a toner having a volume-median particle size ($D_{50}$) of 5.7 μm.

Comparative Example 5

One-hundred parts by weight of resin binders shown in Table 2, 7 parts by weight of a colorant "ECB-301" (commercially available from DAINICHISEIKA COLOR & CHEMICALS MFG. CO., LTD.), 5 parts by weight of a carnauba wax "WAX-C1" (commercially available from S. Kato & CO.), and 0.5 parts by weight of a charge control agent "LR-147" (commercially available from Japan Carlit, Ltd.) were mixed with a Henschel mixer while stirring, and the mixture was then melt-kneaded with a twin-screw kneader.

As the twin-screw kneader, a co-rotating twin-screw extruder having an entire length of the kneading portion of 1560 mm, a screw diameter of 42 mm and a barrel inner diameter of 43 mm was used. The set temperature for the barrel was 90° C. (temperature of kneaded mixture: 130° C.), a screw rotational speed of the roller was 200 r/min, a feeding rate of the mixture was 10 kg/h, and an average residence time was about 18 seconds.

The resulting kneaded mixture was rolled with a cooling roller to cool, and the cooled mixture was then pulverized with a jet mill and classified in the same manner as in Example 1, to provide toner matrix particles having a volume-median particle size ($D_{50}$) of 5.7 μm.

The ratio of the amount of the toner obtained to that of the supplied kneaded mixture was calculated as an yield in pulverization and classification to evaluate productivity, in the same manner as in Example 1. The results are shown in Table 2.

Subsequently, the resulting toner matrix particles and the external additives were subjected to an external addition treatment step in the same manner as in Example 1, to provide a toner having a volume-median particle size ($D_{50}$) of 5.7 μm.

Test Example 1

Low-Temperature Fixing Ability

The toner of each of Examples and each of Comparative Examples was loaded in a nonmagnetic monocomponent development device "MicroLine 5400" (commercially available from Oki Data Corporation), and a solid image of 3 cm×8 cm was printed on Xerox L sheet (A4) with adjusting the amount of toner adhered to 0.50 mg/cm$^2$, and an image was taken out in an unfixed state.

Next, the unfixed image was fixed with an external fixing device, a modified fixing device of "MicroLine 3050" (commercially available from Oki Data Corporation) at each temperature at a fixing speed of 100 mm/sec, while raising the fixing temperature from 130° to 200° C. in an increment of 5° C., to provide a fixed solid image. Thereafter, a mending tape was adhered to the solid image portion, and the mending tape was gently removed. The image densities before the adhesion and after the removal of the mending tape were respectively measured, and a fixing ratio, i.e. image density after removal of the tape/image density before adhesion of the tape×100, was calculated. A temperature at which a fixing ratio is 70% or more is defined as the lowest fixing temperature, and the low-temperature fixing ability was evaluated. The results are shown in Table 2. It is preferable that a toner has a lowest fixing temperature of 150° C. or less.

Test Example 2

Durability at High Temperatures

The toner of each of Examples and each of Comparative Examples was loaded in a nonmagnetic monocomponent development device "MicroLine 5400" (commercially available from Oki Data Corporation), and a durability test was conducted at a print coverage of 0.3%, under environmental conditions of 35° C. and a relative humidity of 50%. Solid images were printed out every 1 hour, and whether or not a white streak was generated over the solid images due to filming of the blade was observed and evaluated, to evaluate durability. The test was halted at a point where the generation of the white streak was confirmed, and the test was conducted for at most 12 hours. The results are shown in Table 2. It is preferred that the white streak is not generated until 6 hours.

It can be seen from the above results that toners excellent in both low-temperature fixing ability and durability are obtained in Examples 1 to 7 in high yields in pulverization and classification, as compared to those of Comparative Examples 1 to 5, by adjusting the amounts of the amorphous polyester and the crystalline polyester blended and the ratios of those average particle sizes to desired ranges, and producing the toners with the open-roller type kneader.

The toner obtained according to the present invention is used in, for example, the development of a latent image formed in electrophotography, electrostatic recording method, electrostatic printing method or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing a toner, comprising feeding raw materials comprising a resin binder and a colorant to an open-roller type kneader, and then melt-kneading the raw materials, wherein the resin binder comprises a crystalline polyester and an amorphous polyester, each being in particle form, and wherein the crystalline polyester and the amorphous polyester fed to the open-roller type kneader are in a weight ratio, i.e. crystalline polyester/amorphous polyester, of from 5/95 to 30/70, and have a ratio of average particle sizes of crystalline polyester/amorphous polyester of from 1.5 to 4.0.

2. The method according to claim 1, wherein the crystalline polyester has an average particle size of from 1.5 to 5.5 mm.

3. The method according to claim 1, wherein the amorphous polyester has a softening point that is higher than that of the crystalline polyester, and the difference in softening points is within 30° C.

4. The method according to claim 1, wherein the open-roller type kneader is temperature-controlled to have a tem-

TABLE 2

| | Resin Binders | | Ratio of Average | | Productivity | Evaluations of Toner | |
|---|---|---|---|---|---|---|---|
| | Amorphous Polyester [A] | Crystalline Polyester [C] | Particle Size [C/A] | Kneader | Yield in Pulverization and Classification | Low-Temperature Fixing Ability [Lowest Fixing Temperature] | Durability [Time at Generation of White Streak] |
| Example 1 | Resin A/80 | Resin C/20 | 3.2 | Open roller | 65% | 140° C. | 10 hours |
| Example 2 | Resin B/80 | Resin C/20 | 1.8 | Open roller | 65% | 130° C. or less | 8 hours |
| Example 3 | Resin A/95 | Resin D/5 | 2.2 | Open roller | 70% | 150° C. | 12 hours or more |
| Example 4 | Resin A/80 | Resin D/20 | 2.2 | Open roller | 60% | 130° C. or less | 10 hours |
| Example 5 | Resin A/70 | Resin D/30 | 2.2 | Open roller | 55% | 130° C. or less | 8 hours |
| Example 6 | Resin B/80 | Resin E/20 | 2.5 | Open roller | 65% | 135° C. | 10 hours |
| Example 7 | Resin A/80 | Resin F/20 | 2.0 | Open roller | 70% | 135° C. | 11 hours |
| Comparative Example 1 | Resin B/80 | Resin D/20 | 1.2 | Open roller | 60% | 130° C. or less | 4 hours |
| Comparative Example 2 | Resin A/80 | Resin E/20 | 4.5 | Open roller | 60% | 155° C. | 10 hours |
| Comparative Example 3 | Resin A/98 | Resin D/2 | 2.2 | Open roller | 70% | 165° C. | 12 hours or more |
| Comparative Example 4 | Resin A/60 | Resin D/40 | 2.2 | Open roller | 30% | 130° C. or less | 3 hours |
| Comparative Example 5 | Resin A/80 | Resin D/20 | 2.2 | Twin screw | 45% | 130° C. or less | 5 hours |

Note)
Amounts of the resin binders are expressed by parts by weight.

perature at a discharging outlet of a kneaded mixture set to be lower than a softening point of the crystalline polyester.

5. The method according to claim 1, wherein the crystalline polyester is a polyester obtained by polycondensing an alcohol component comprising an α,ω-linear alkanediol and a carboxylic acid component comprising an aliphatic dicarboxylic acid compound.

6. The method according to claim 1, wherein the crystalline polyester is a polyester obtained by polycondensing an alcohol component comprising an α,ω-linear alkanediol and a carboxylic acid component comprising an aromatic dicarboxylic acid compound.

7. The method according to claim 1, wherein said ratio of average particle sizes is from 1.5 to 3.0.

8. The method according to claim 1, wherein said ratio of average particle sizes is from 2.0 to 3.0.

9. The method according to claim 1, wherein said ratio of average particle sizes is from 2.0 to 2.5.

10. The method according to claim 2, wherein said average particle size is from 1.5 to 4.0 mm.

11. The method according to claim 2, wherein said average particle size is from 2.0 to 3.5 mm.

12. The method according to claim 2, wherein said average particle size is from 2.0 to 3.0 mm.

13. The method according to claim 1, wherein the amorphous polyester has an average particle size of from 0.5 to 4.0 mm.

14. The method according to claim 1, wherein the amorphous polyester has an average particle size of from 1.0 to 3.0 mm.

15. The method according to claim 1, wherein said weight ratio is from 10/90 to 25/75.

16. The method according to claim 1, wherein said weight ratio is from 15/85 to 25/75.

17. The method according to claim 3, wherein the difference in softening points is from 2° to 20° C.

18. The method according to claim 3, wherein the crystalline polyester has a softening point of from 90° C. to 120° C.

19. The method according to claim 3, wherein the amorphous polyester has a softening point of 110° C. or higher and lower than 140° C.

20. The method according to claim 1, wherein the crystalline polyester has a weight-average molecular weight of 30,000-100,000.

* * * * *